US005426446A

United States Patent [19]

Takei et al.

[11] Patent Number: 5,426,446

[45] Date of Patent: Jun. 20, 1995

[54] DISPLAY DEVICE

[75] Inventors: Toshikazu Takei; Masao Saito, both of Kyoto, Japan

[73] Assignee: Rohm Co., Ltd., Kyoto, Japan

[21] Appl. No.: 984,675

[22] Filed: Dec. 2, 1992

[30] Foreign Application Priority Data

Dec. 3, 1991 [JP] Japan ..... 3-348209

[51] Int. Cl.[6] ..... G09G 3/32

[52] U.S. Cl. ..... 345/82; 345/83; 345/204

[58] Field of Search ..... 340/766, 782, 783, 784, 340/813; 359/55, 57, 58, 84; 345/82, 83, 84, 87, 204, 211

[56] References Cited

U.S. PATENT DOCUMENTS 4,823,121 4/1989 Sakamoto et al. ..... 345/211
5,134,387 7/1992 Smith et al. ..... 340/782
5,184,114 2/1993 Brown ..... 340/782

*Primary Examiner*—Ulysses Weldon

*Assistant Examiner*—Matthew Luu

*Attorney, Agent, or Firm*—Brumbaugh, Graves, Donohue & Raymond

[57] ABSTRACT

LED pairs each consisting of two LEDs are arranged in a matrix form to constitute a LED module. Receiving an external clock signal, a timing control circuit generates common signals that set on-periods of drive currents for the LEDs. Each display drive circuit includes first and second drive elements. The first drive element commonly serves the two LEDs of the LED pair, and is turned on during the on-period set by the common signal. The second drive element has two transistors that separately serve the two LEDs of the LED pair and are turned on in accordance with respective color selection signals. The display drive circuits selectively provide drive currents to the LEDs through the first and second drive elements being turned on. When detecting a stop of the clock signal, a common signal control circuit cut off the first drive elements by canceling the common signals.

6 Claims, 7 Drawing Sheets

DISPLAY DEVICE

BACKGROUND OF THE INVENTION

The present invention relates to a display drive circuit used for driving various display devices such as a fluorescent character display tube, a plasma display, a LCD display and a LED display.

FIG. 8 shows a conventional display device which displays an arbitrary pattern such as characters using a plurality of display elements such as LEDs. This display device has a drive circuit 4 for selectively providing a drive current to one LED 2 of a LED module. In the drive circuit 4, transistors 8, 10 are provided on the cathode side of the LED 2 and form a switching circuit that intermittently turns on the LED 2 in response to a common signal COM, and a transistor 12 is provided on the anode side of the LED 2 and turned on in response to a color signal Ci. That is, a series circuit is formed by a resistor 14 and a transistor 12 that are provided on the side of a power supply line 16, and a transistor 10 provided on the ground side. The color signal Ci decreases the base voltage of the transistor 12 to a low (L) level to turn on the transistor 12. During a L-level period of the common signal COM, the transistors 8, 10 are turned on, so that a drive current intermittently flows through the LED 2 to turn it on as long as the color signal Ci is provided to the LED 2. Although the LED 2 is turned on intermittently in accordance with the common signal COM, the human eyes recognize the lighting state of the LED 2 as continuous because of high-frequency switching by the common signal COM.

However, the above display device can drive only one LED 2 (one color) per one common signal COM. In order to perform a color display using two or more LEDs (two or more colors), the drive circuit 4 should be scaled up in accordance with the number of colors. Thus, the number of components, such as transistors, of the drive circuit 4 will increase proportionally, and the circuit configuration becomes complex.

As shown in FIG. 9, assume here that an LED module 2M, in which LEDs 2 are arranged in a matrix form, is driven by dynamic scanning. If a clock signal, that is a basis of the common signal COM, is stopped, the transistors 8, 10 of the drive circuit 4 (see FIG. 8) are turned on continuously and all of a plurality of LEDs 2 constituting one line 2L are turned on. An overcurrent flowing through each of the LEDs 2 constituting the line 2L will reduce the life of the LEDs 2 of the line 2L. In the worst case, the LEDs 2 will break down.

SUMMARY OF THE INVENTION

An object of the present invention is to provide a display device in which a drive circuit is simplified, and even when a clock signal is stopped a wrong operation can be avoided and display elements protected.

According to the invention, a display device comprises:

a plurality of display elements;

timing control means for generating, based on a clock signal, a plurality of common signals that set on-periods of drive currents for the display elements;

drive means including first and second drive elements, for selectively providing the drive currents to the display elements through the first and second drive elements, the first drive element being turned on during the on-period set by the common signal, the second drive element being turned on in accordance with a display control signal; and common signal control means for canceling, when detecting a stop of the clock signal, the common signals generated by the timing control means to cut off the first drive elements.

According to another aspect of the invention, a display device comprises:

a plurality of display element units each including a plurality of display elements having different light emission colors;

timing control means for generating, based on a clock signal, a plurality of common signals that set on-periods of drive currents for the display element units;

drive means including first and second drive elements, for selectively providing the drive currents to the display elements through the first and second drive elements, the first drive element being commonly serving the display elements of the display element unit and turned on during the on-period set by the common signal, the second drive element separately serving the respective display elements of the display element unit and turned on in accordance with respective display control signals; and common signal control means for canceling, when detecting a stop of the clock signal, the common signals generated by the timing control means to cut off the first drive elements.

DESCRIPTION OF THE PREFERRED EMBODIMENTS

Embodiments of the present invention are described below in detail with reference to the accompanying drawings.

Figure 1:
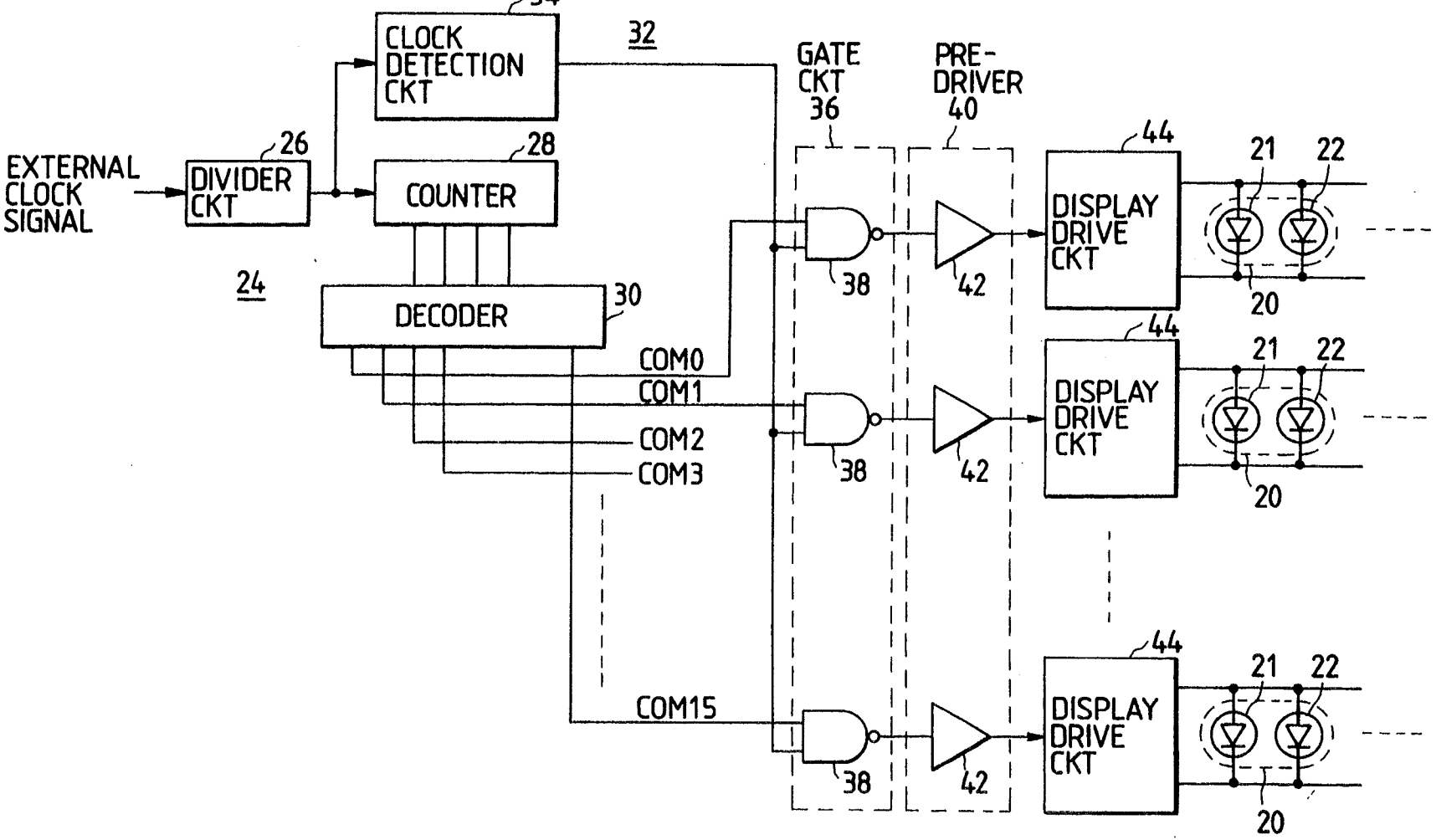
FIG. 1 is a block diagram showing a display device according to an embodiment of the present invention.
Figure 3:
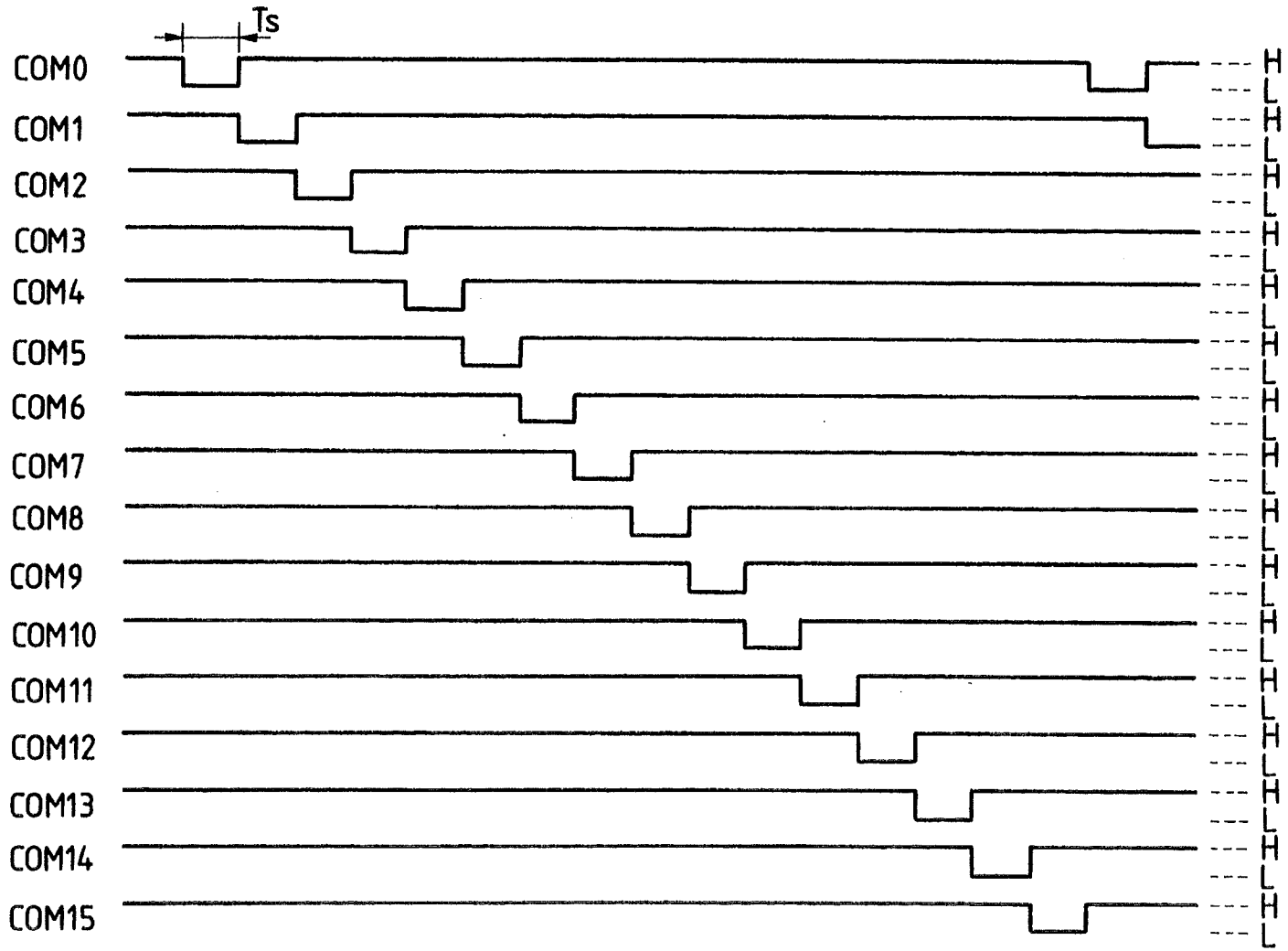

FIG. 1 shows a display device according to an embodiment of the invention, which has a timing control circuit 24 (timing control means) for generating, based on an external clock signal, common signals that correspond to respective display elements. The timing control circuit 24 includes a divider circuit 26 for dividing the external clock signal. The divider circuit 26 converts the external clock signal to a clock signal CLK having a proper frequency. The output of the divider circuit 26 is connected to a counter 28 that serves to form, based on the clock signal CLK, common signals corresponding to the respective display elements to be driven. In this embodiment, the counter 28 is a 4-bit counter. The output of the counter 28 is connected to a decoder 30 for decoding a count value of the counter 28. As shown in FIG. 3, the count value is converted to 16 kinds of common signals (decoder outputs) COM-0–COM15. Each of the common signals COM-0–COM15 includes a L-level section of a predetermined period Ts. The L-level sections set on-periods of respective first drive elements (described later). The L-level section comes repeatedly while the common signals COM0-COM15 are provided continuously.

Figure 2:
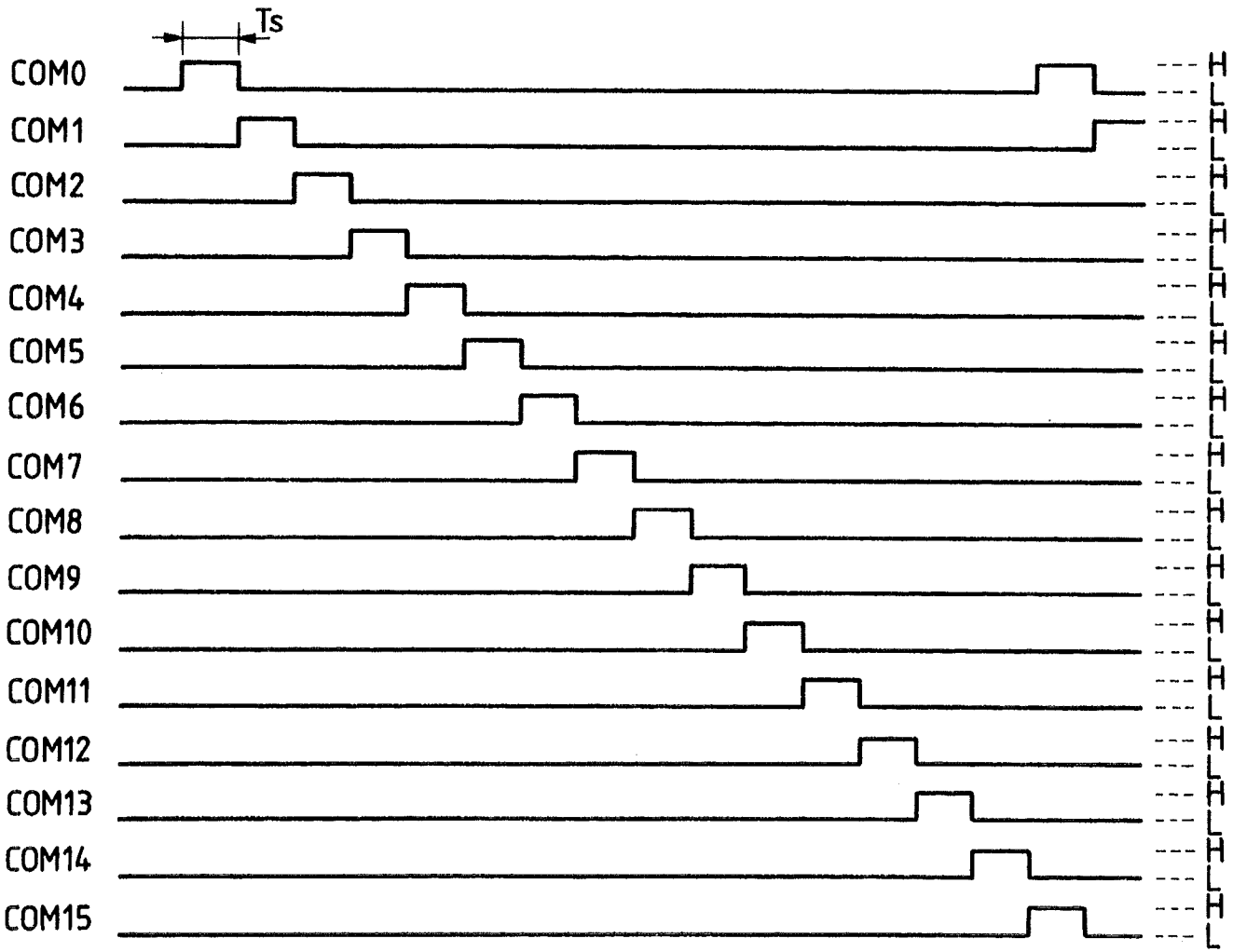
FIGS. 2 and 3 are timing charts showing common signals used in the display device of FIG. 1.

On the output side of the divider circuit 26, there is also provided a common signal control circuit 32 that detects a stop of the clock signal CLK and stops operation of the display elements by canceling the common signals COM0–COM15 generated from the decoder 30. More specifically, the output of the divider circuit 26 is connected to a clock detection circuit 34 that detects the existence of the clock signal CLK output from the divider circuit 26 and generates a H-level signal as a clock detection signal when the clock signal CLK exists. The clock detection circuit 34 is, for instance, a monostable multivibrator that receives the clock signal CLK, and outputs a H-level signal while the clock signal CLK exists. The output of the clock detection circuit 34 is connected to a gate circuit 36 that allows passage of the common signals COM0–COM15 while the clock signal CLK exists. In this embodiment, NAND circuits 38 are provided for the respective common signals COM0–COM15, and pass or interrupt the common signals COM0–COM15 based on whether the clock detection signal and the respective common signals COM0–COM15 satisfy the NAND condition. The output of the gate circuit 36 is connected to a pre-driver 40, which outputs pulse signals (see FIG. 3) as inverted signals of the common signals COM0–COM15 of FIG. 2. The pre-driver 40 has buffer circuits 42 to receive the respective common signals COM0–COM15. That is, the common signals COM0–COM15 generated by the timing control circuit 24 are provided to respective display drive circuits 44 via the gate circuit 36 and the pre-driver 40.

Each display drive circuit 44 is connected to a plurality of display elements or to a plurality of LED pairs (display element pairs) 20 each consisting of LEDs 21, 22. In this embodiment, the LEDs 21, 22 have green and red emission colors, respectively.

Figure 4:
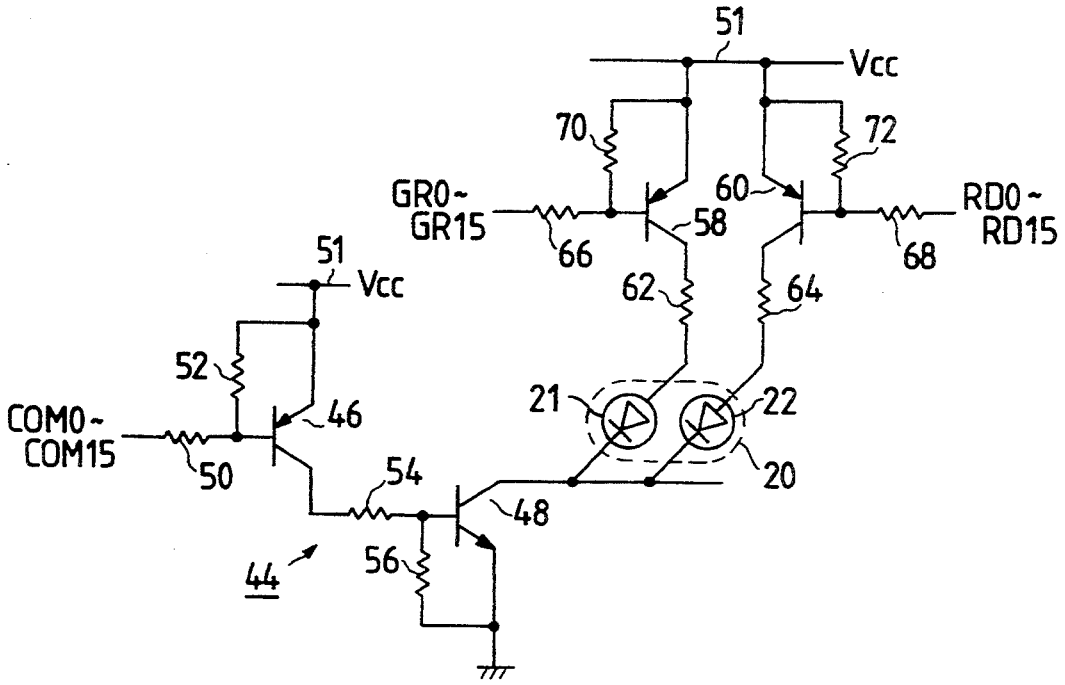
FIG. 4 shows a display drive circuit of the display device of FIG. 1.

FIG. 4 shows a specific circuit configuration of the display drive circuit 44. Transistors 46, 48 as the first drive element, which are turned on in response to the common signal COM0, COM1, . . . or COM15, are provided on the cathode side of the LED pair 20, i.e., on the round side. The transistors 46, 48 are p-n-p and n-p-n transistors, respectively. A resistor 50 is connected to the base of the transistor 46. Further, a power supply voltage Vcc of a power line 51 is applied to the base of the transistor 46 via a resistor 52 to provide a predetermined bias voltage to it. The power supply voltage Vcc is also applied to the emitter of the transistor 46. A resistor 54 is connected between the collector of the transistor 46 and the base of the transistor 48. The emitter of the transistor 48 is grounded, and its base is also grounded via a resistor 56 to provide a bias voltage when the transistor 46 is turned on.

The display drive circuit 44 further has transistors 58, 60 as a second drive element, which serve to turn on the LED pair 20 in response to display control signals, and are provided on the anode side of the LED pair 20. More specifically, a series connection of the transistor 58 and a resistor 62 is provided between the power line 51 and the LED 21, and a series connection of the transistor 60 and a resistor 64 is provided between the power line 51 and the LED 22. Resistors 66, 68 are connected to the bases of the transistors 58, 60, respectively. Further, the transistors 58, 60 are given predetermined bias voltages via resistors 70, 72, respectively. A green selection signal GR0, GR1, . . . or GR15 as a color display control signal is provided to the base-input side of the transistor 58, and a red selection signal RD0, RD1, or RD15 as another color display control signal is provided to the base-input side of the transistor 60.

Figure 5:
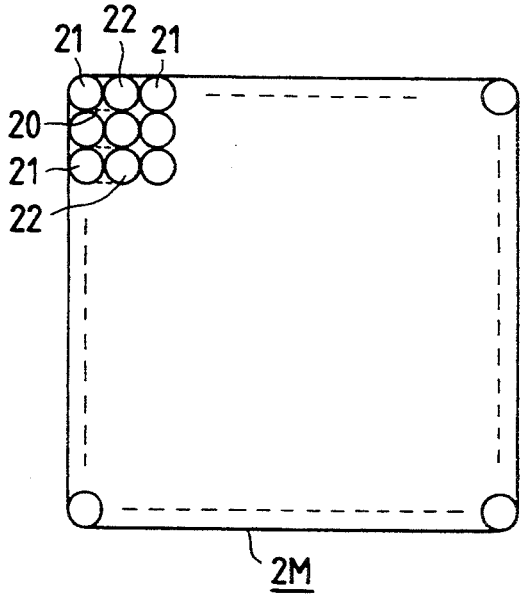
FIG. 5 shows a LED module of the display device of FIG. 1.
Figure 6:
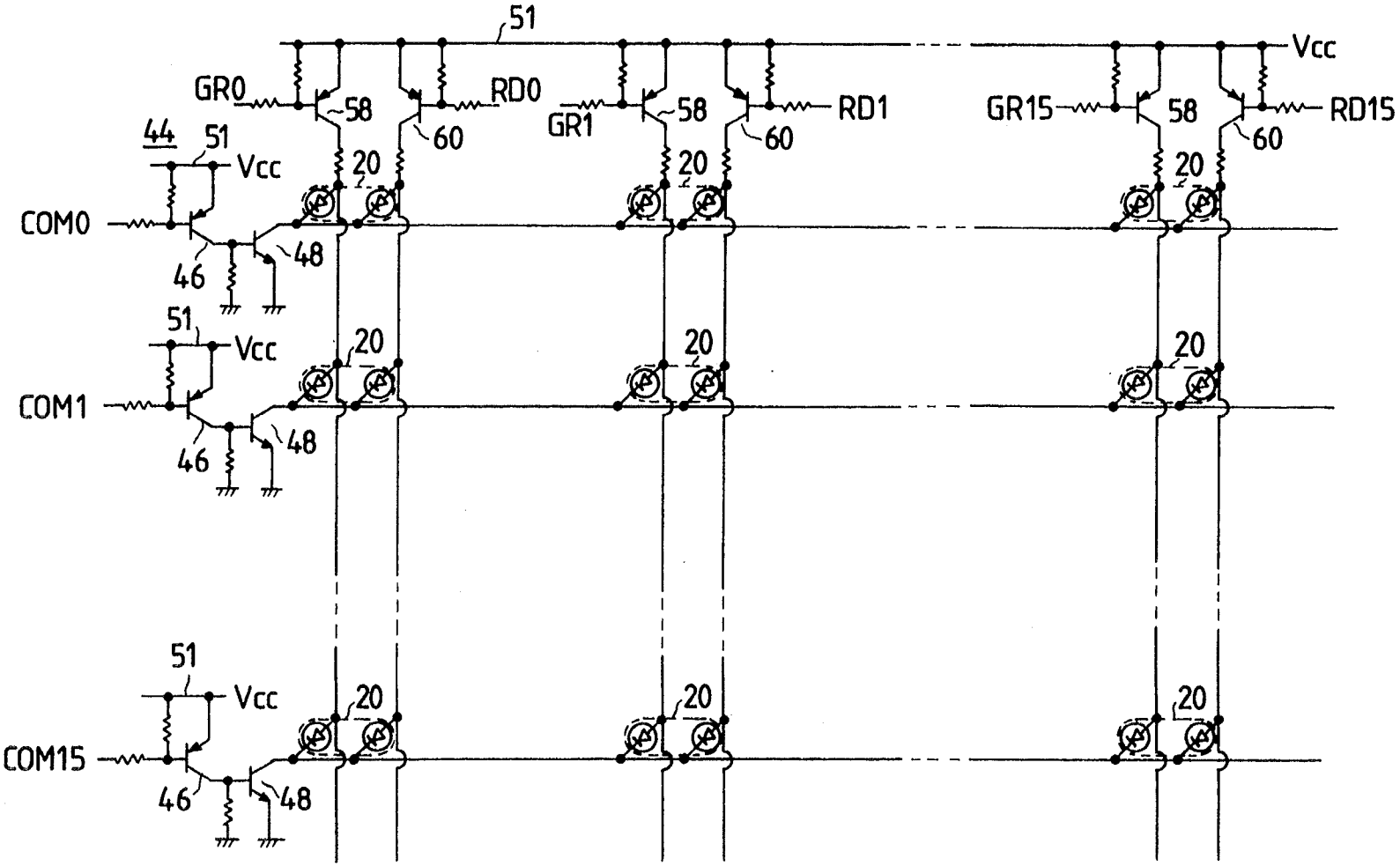
FIG. 6 shows display drive circuits for the LED module of FIG. 5.

To drive a LED module (display module) 2M in which the LED pairs 20 are arranged to form a matrix of a plurality (m) of rows by a plurality (n) of columns (see FIG. 5), the LED pairs 20 are grouped on a row-by-row basis and on a column-by-column basis (see FIG. 6). The transistors 46, 48 as the first drive elements are provided for the respective rows and the transistors 58, 60 as the second drive elements are provided for the respective columns, to selectively supply a drive current to the LED pairs 20. In this embodiment, since the LED pair 20 consists of the LEDs 21, 22, the two transistors 58, 60 are employed. If only one of the LEDs 21, 22 is used, the second drive element may be constituted of either of the transistors 58, 60.

With the above-described configuration, the clock signal CLK generated by dividing the external clock signal in the divider circuit 26 is input to the counter 28. Counting the clock signal CLK, the counter produces the 4-bit count output, which is input to the decoder 30. The decoder 30 produces the 16 kinds of common signals COM0–COM15 (see FIG. 2) that correspond to the count outputs of 0000–1111. The common signals COM0–COM15 are provided to the respective NAND circuits 38.

On the other hand, while receiving the clock signal CLK, the clock detection circuit 34 produces the H-level clock detection signal, which is input to all the NAND circuits 38. The NAND circuits 38 individually produce logic outputs based on the clock detection signal and the common signals COM0–COM15. These logic outputs are provided to the display drive circuits 44 via the buffer circuits 42.

In the display drive circuit 44, during the on-period Ts of the common signal COM0, COM1, . . . or COM15, a base current flows into the buffer circuit 42 of the pre-driver 40 and the transistor 46 is turned on. In response, a base current flows through the transistor 48 via the transistor 46 and the transistor 48 is also turned on, thereby enabling a drive current to flow through the LEDs 21, 22.

Referring to FIGS. 4 and 6, when the green selection signal GR0 (L level) is provided to the base of the transistor 58 of the display drive circuit 44, the transistor 58 is turned on. As a result, a drive current flows through the transistor 58, LED 21 and transistors 48 that are turned on sequentially and intermittently in response to the arrival of on-sections of the common signals COM-0–COM15. Thus, the LEDs 21 on one line (i.e., first column) are turned on to emit green light. Although the turn-on periods of the respective LEDs 21 on that line slightly deviate from each other depending on the common signals COM0–COM15, the LEDs 21 can be regarded as emitting light continuously due to the high turn-on frequency and the afterimage phenomenon, causing no unfavorable effects on a displayed image.

When the red selection signal RD0 (L level) is applied to the base of the transistor 60, the transistor 60 is turned on. As a result, a drive current flows through the transistor 60, LED 22 and transistors 48 that are turned on sequentially and intermittently in response to the arrival of on-sections of the common signals COM-0–COM15. Thus, the LEDs 22 on one line (i.e., second column) are turned on to emit red light.

If the green selection signal GR0 (L level) is applied to the base of the transistor 58 and the red selection signal RD0 (L level) is applied to the base of the transistor 60, both LEDs 21, 22 of the LED pair 20 are turned on to simultaneously emit green light and red light, respectively. Thus, the LED pair 20 is regarded as emitting light of orange, a color between green and red.

The display device under discussion can perform a display of four colors in total, i.e., black when the LED pair 20 is turned off, green when only the LED 21 is turned on, red when only the LED 22 is turned on, and orange when both LEDs 21, 22 are turned on. In addition to this color display, various color patterns including characters, symbols, and figures, etc. can be displayed by selectively turning on the LED pairs 20 arranged in a matrix form on the LED module 2M. Further, if a plurality of display modules 2M are arranged in a matrix form, an arbitrary pattern can be displayed with each display module 2M acting as a unit of the display.

When the external clock signal is stopped, the clock detection signal is switched to the L level which indicates that the clock signal CLK has been stopped. Because of the stop of the clock signal CLK, the NAND circuits 38 produce a H-level output even if the common signals COM0–COM15 from the decoder 30 are at the H level, so that the outputs of the buffer circuits 42 are canceled. As a result, the outputs of the display drive circuits 44 are canceled, and the transistors 46, 48 stop their operation, i.e., are rendered in a cutoff state to interrupt a drive current from the LED pair 20. Therefore, even when the transistors 58, 60 are turned on by the display control signal, a drive current does not pass through the LED pairs 20, so that the LED pairs 20 can be protected from the breakdown, which would otherwise occur due to their continuous lighting even during the stop of the clock signal CLK.

Figure 7:
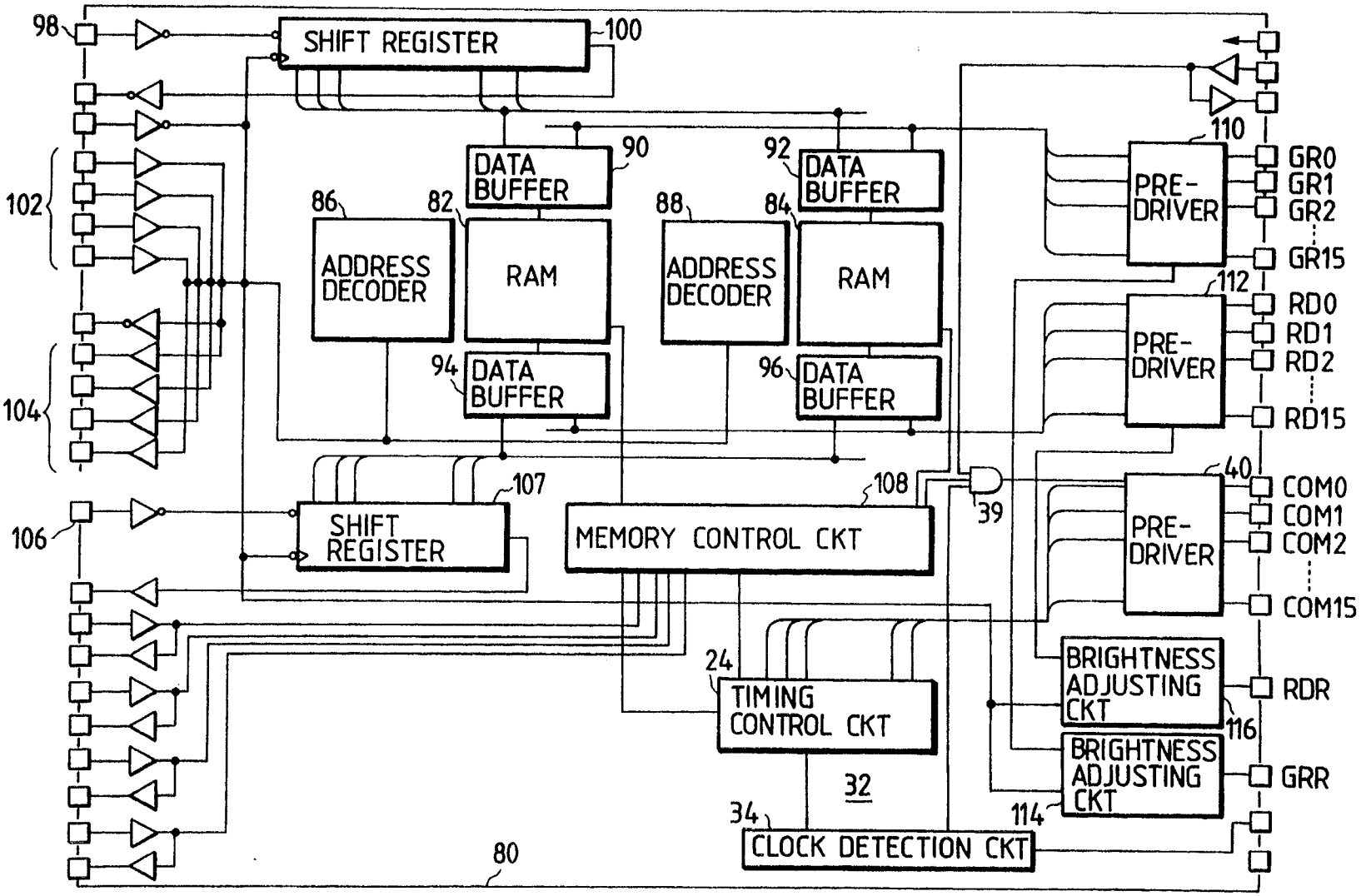
FIG. 7 is a block diagram showing a specific configuration of a display device according to another embodiment of the invention.
Figure 8:
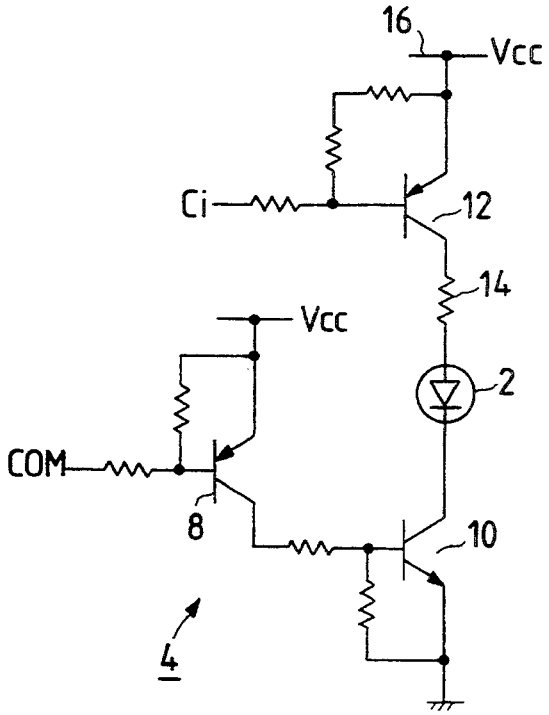
FIG. 8 PRIOR ART
FIG. 8 shows a drive circuit of a conventional display device.
Figure 9:
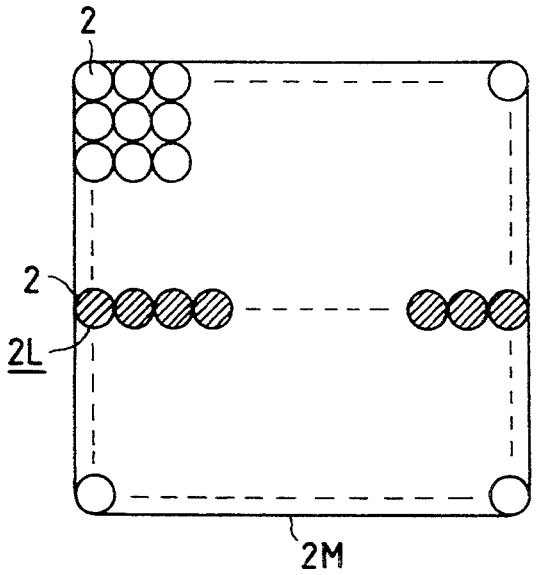
FIG. 9 PRIOR ART
FIG. 9 shows a LED module that is driven by the drive circuit of FIG. 8.

FIG. 7 shows a specific circuit configuration of another display device which is similar to that of FIG. 1. A display control unit 80 of the display device is constituted in the form of a one-chip IC. The display control unit 80 has RAMs 82, 84 as two memory devices for storing color display data etc. Reference numerals 86 and 88 represent address decoders, and numerals 90, 92, 94 and 96 represent data buffers. Green data is applied to an input terminal 98, and stored into the RAMs 82, 84 via a shift register 100 and the data buffers 90, 92. Input terminals 102, 104 are address input terminals. Red data is applied to an input terminal 106, and stored into the RAMS 82, 84 via a shift register 107 and the data buffers 94, 96.

The display control unit 80 further includes the timing control circuit 24, the common signal control circuit 32 and a memory control circuit 108 for controlling the RAMs 82, 84. In this embodiment, the clock detection circuit 34 is provided in the common signal control circuit 32, and a single AND circuit 39 is provided, instead of the NAND circuits 38, as the gate circuit 36.

In the display control circuit 80, the green selection signals GR0–GR15 are produced based on the green data read from the RAMs 82, 84, and output via a pre-driver 110. Red selection signals RD0–RD15 are output via a pre-driver 112. The green selection signals GR0–GR15 are applied to the bases of the transistors 58 of the display drive circuits 44 (see FIG. 6), respectively, and the red selection signals RD0–RD15 are applied to the bases of the transistors 60 of the display drive circuits 44, respectively. The common signals COM0–COM15 generated by the timing control circuit 24 are output via the pre-driver 40 and applied to the bases of the transistors 46 of the display drive circuits 44, respectively.

Reference numeral 114 represents a brightness adjusting circuit for green which adjusts the output levels of the predriver 110 in accordance with a green brightness adjustment input GRR. Reference numeral 116 represents a brightness adjusting circuit for red which adjusts the output levels of the pre-driver 112 in accordance with a red brightness adjustment input RDR.

With the above configuration, the operation of the pre-driver 40 is controlled by an output (logical product) of the AND circuit 39 which is produced based on the output of the clock detection circuit 34. That is, when the clock signal CLK is stopped, the common signals COM0–COM15 (outputs of the pre-driver 40) are canceled, so that the transistors 46, 48 of the display drive circuit 44 are rendered in a cutoff state. Therefore, the LED pairs 20 can be prevented from wrong operation, and protected from breakdown due to a flow of overcurrent.

Although the above embodiments are described of the case of the LED pair 20 consisting of the two LEDs 21, 22, the invention can be applied to a LED module in which the LED unit consists of three or more LEDs or a single LED, and to a display module constituted of display elements other than LEDs.

As described above, the invention provides the following advantages:

(1) When the clock signal is stopped, the stop of the clock signal is detected and the common signals, which are generated based on the clock signal, are canceled, so that the first drive elements of the display drive circuits are cut off. Therefore, the display elements or display element units can be prevented from wrong operation and protected from breakdown due to a flow of overcurrent. Thus, more reliable display can be realized.

(2) By separately driving a plurality of display elements of a display element unit that have different light emission colors, a display can be performed with different colors.

(3) By arranging display elements or display element units in a matrix form, and selectively turning on or off the display elements or display element units, or one or more display elements of the display element units, arbitrary patterns such as characters and figures can be displayed.

What is claimed is:

1. A display device comprising:

a plurality of display elements;

timing control means for generating, based on a clock signal, a plurality of common signals that set on-periods of drive currents for the display elements;

drive means including first and second drive elements, for selectively providing the drive currents to the display elements through the first and second drive elements, the first drive element being turned on during the on-period set by the common signal, the second drive element being turned on in accordance with a display control signal; and common signal control means for detecting a stop of the clock signal and canceling, when detecting a stop of the clock signal, the common signals generated by the timing control means to cut off the first drive elements.

2. The display device of claim 1, wherein the display elements are arranged in a matrix to constitute a display module.

3. The display device of claim 2, wherein the first drive elements are provided for respective rows of the matrix, and the second drive elements are provided for respective columns of the matrix.

4. A display device comprising:

a plurality of display element units each including a plurality of display elements having different light emission colors;

timing control means for generating, based on a clock signal, a plurality of common signals that set on-periods of drive currents for the display element units;

drive means including first and second drive elements, for selectively providing the drive currents to the display elements through the first and second drive elements, the first drive element being commonly serving the display elements of the display element unit and turned on during the on-period set by the common signal, the second drive element separately serving the respective display elements of the display element unit and turned on in accordance with respective display control signals; and common signal control means for detecting a stop of the clock signal and canceling, when detecting a stop of the clock signal, the common signals generated by the timing control means to cut off the first drive elements.

5. The display device of claim 4, wherein the display element units are arranged in a matrix to constitute a display module.

6. The display device of claim 5, wherein the first drive elements are provided for respective rows of the matrix, and the second drive elements are provided for respective columns of the matrix.

* * * * *